US009063475B2

(12) United States Patent
Aoto et al.

(10) Patent No.: US 9,063,475 B2
(45) Date of Patent: Jun. 23, 2015

(54) INTERMEDIATE TRANSFER BELT AND ELECTROPHOTOGRAPHIC APPARATUS

(75) Inventors: Jun Aoto, Kanagawa (JP); Hidetaka Kubo, Kanagawa (JP); Kenichi Mashiko, Kanagawa (JP); Sayaka Katoh, Kanagawa (JP); Shinichi Nitta, Miyagi (JP)

(73) Assignee: RICOH COMPANY, LTD., Tokyo (JP)

( * ) Notice: Subject to any disclaimer, the term of this patent is extended or adjusted under 35 U.S.C. 154(b) by 341 days.

(21) Appl. No.: 13/109,540

(22) Filed: May 17, 2011

(65) Prior Publication Data

US 2011/0293824 A1 Dec. 1, 2011

(30) Foreign Application Priority Data

May 25, 2010 (JP) ..... 2010-119377

(51) Int. Cl.
*B05D 1/36* (2006.01)
*G03G 15/01* (2006.01)
*G03G 15/16* (2006.01)

(52) U.S. Cl.
CPC ..... *G03G 15/162* (2013.01); *G03G 15/1605* (2013.01); *G03G 15/161* (2013.01)

(58) Field of Classification Search
None
See application file for complete search history.

(56) References Cited

U.S. PATENT DOCUMENTS

| | | | | |
|---|---|---|---|---|
| 5,666,193 | A | 9/1997 | Rimai et al. | |
| 5,745,831 | A | 4/1998 | Nakazawa et al. | |
| 6,753,399 | B2 * | 6/2004 | Inokuchi | 528/14 |
| 2005/0191099 | A1 * | 9/2005 | Yamaguchi et al. | 399/346 |
| 2011/0177238 | A1 * | 7/2011 | Aoto et al. | 427/152 |

FOREIGN PATENT DOCUMENTS

| | | |
|---|---|---|
| JP | 9-230717 | 9/1997 |
| JP | 9-281813 | 10/1997 |
| JP | 10-39647 | 2/1998 |
| JP | 2002-162767 | 6/2002 |
| JP | 2006-330242 | 12/2006 |
| JP | 2007-65018 | 3/2007 |
| JP | 2007-328165 | 12/2007 |
| JP | 2007328165 A * | 12/2007 |
| JP | 2009-75154 | 4/2009 |
| JP | 4430892 | 12/2009 |
| JP | 2010-107967 | 5/2010 |

OTHER PUBLICATIONS

Timco Rubber, Thermoplastic Elastomers, retrieved May 2, 2013, pp. 1-2.*
Jul. 20, 2011 European search report in connection with counterpart European patent application No. 11 16 7312.

* cited by examiner

*Primary Examiner* — Callie Shosho
*Assistant Examiner* — Patrick English
(74) *Attorney, Agent, or Firm* — Cooper & Dunham LLP

(57) ABSTRACT

To provide an intermediate transfer belt for use in an electrophotographic apparatus, including as an outermost surface thereof: uniform convex regions formed by aligning independent spherical resin particles in a surface direction; and depressed regions formed of a lubricant layer which respectively lie between the convex regions.

11 Claims, 4 Drawing Sheets

INTERMEDIATE TRANSFER BELT AND ELECTROPHOTOGRAPHIC APPARATUS

BACKGROUND OF THE INVENTION

1. Field of the Invention

The present invention relates to an intermediate transfer belt to be installed in an electrophotographic apparatus such as a copier or printer, a method for producing the intermediate transfer belt, and an electrophotographic apparatus using the intermediate transfer belt, and relates particularly to an intermediate transfer belt suitable for full-color image formation, and an electrophotographic apparatus using the intermediate transfer belt suitable for full-color image formation.

2. Description of the Related Art

Conventionally, for a variety of purposes, seamless belts have been used as members incorporated in electrophotographic apparatuses.

In a present-day full-color electrophotographic apparatus, in particular, the method using an intermediate transfer belt is employed, wherein developed images of four colors, i.e., yellow, magenta, cyan and black, are temporarily superimposed onto one another over an intermediate transfer medium and then transferred onto a transfer medium (such as paper) at one time.

The foregoing method using an intermediate transfer belt, conventionally used in a system in which developing devices for four colors are used with one photoconductor, is disadvantageous in that the printing speed is low. Accordingly, for high-speed printing, the four-drum tandem method is often used, wherein photoconductors for four colors are aligned and images of each color are continuously transferred to paper. However, in the four-drum tandem method, for example due to variation of paper that arises depending upon the environment, it is very difficult to secure positional accuracy for superimposition of images of each color, and consequently images with displaced colors are often formed. Accordingly, employment of the intermediate transfer method in the four-drum tandem method is becoming popular.

Under these circumstances, demands for properties (such as high-speed transfer and positional accuracy) of the intermediate transfer belt are heightening and it is becoming necessary to satisfy these demanded properties. For positional accuracy, in particular, reduction in variation caused by deformation (e.g., expansion) of the belt itself, which results from continuous use, is demanded. Also, since the intermediate transfer belt is laid out over a wide area in an apparatus and high voltage is applied thereto for image transfer, the intermediate transfer belt is required to be flame-retardant. To meet such demands, polyimide resins, polyamide-imide resins and the like, which are highly elastic, highly heat-resistant resins, are primarily used as materials for intermediate transfer belts.

It should, however, be noted that an intermediate transfer belt formed of a polyimide resin has high strength and thus high surface hardness; thus, high pressure is applied to a toner layer when a toner image is transferred, and there is local aggregation of toner, thereby possibly forming a partially non-transferred image where part of the image is not transferred. Moreover, the intermediate transfer belt is inferior in terms of its conformity to a photoconductor and to a medium (such as paper) that the intermediate transfer belt touches at a transfer section; consequently, in some cases, portions of faulty contact (empty spaces) are created at the transfer section and thus transfer unevenness may arise.

Nowadays, images are frequently formed on a variety of types of paper, using full-color electrophotography, and there are increasing occasions where types of paper varying from slippery, highly smooth paper, such as coated paper, to paper with rough surfaces, such as recycled paper, embossed paper, Japanese paper and kraft paper, are used. Conformity to such paper with different surface properties is important; poor conformity could cause paper to have color tone unevenness and shade unevenness in a concavo-convex form.

To solve the foregoing problems, a variety of intermediate transfer belts wherein a relatively flexible layer is laid over a base layer have been proposed.

In the case where a relatively flexible layer is used as a surface layer of an intermediate transfer belt, transfer pressure can be reduced and conformity to protrusions and depressions of a paper surface can be improved; however, there is a problem in that since the surface layer is inferior in releasability, toner cannot be favorably released from the surface layer, which causes a decrease in transfer efficiency, and the above favorable effects cannot be fully taken advantage of. Moreover, there is another problem in that the surface layer is inferior in abrasion resistance and scratch resistance as well.

To solve these problems, there is a method of providing a protective layer in addition to the above-mentioned layers; however, this method is unfavorable because if a material with sufficiently high transfer performance is coated with the protective layer, it is difficult for the protective layer to conform to the flexibility of a flexible layer, and thus cracks and peeling are easily caused.

Meanwhile, improvement in transferrability by attachment of fine particles to a surface has been proposed.

Japanese Patent Application Laid-Open (JP-A) No. 09-230717 proposes covering an intermediate transfer member with beads which are 3 μm or less each in diameter.

However, the formation method described in this laid-open patent application is not sufficient in terms of durability required for present-day electrophotographic apparatuses because detachment of particles arises.

JP-A Nos. 2002-162767 and 2004-354716 propose formation of a layer with the use of a material which has an affinity for hydrophobized fine particles. In these laid-open patent applications, particles having very small diameters are preferably used.

However, a thick particle layer is formed, nonuniform portions are created by aggregation of particles and there is variation in transfer performance; consequently, it is difficult to obtain an intermediate transfer belt which can help satisfy the high-level image quality that present-day electrophotographic apparatuses are required to yield.

JP-A Nos. 2007-328165 and 2009-75154 propose realizing durability by burying relatively large particles in a resin to some extent. However, in these proposals as well, the particles are present nonuniformly, and thus it is difficult to obtain an intermediate transfer belt which can help satisfy the high-level image quality that the present-day electrophotographic apparatuses are required to yield.

Silica is preferably used in all of the above-mentioned techniques in related art; note that since silica particles have strong cohesive force, it is difficult to form a uniform particle layer. Moreover, inorganic particles such as silica particles scratch the surface of an organic photoconductor suitably used as a latent image bearing member in charge of image formation, and cause the surface to be easily abraded and to decrease in durability, as the inorganic particles come into contact with the organic photoconductor at a transfer section.

BRIEF SUMMARY OF THE INVENTION

The present invention is designed in light of the above-mentioned techniques in related art and aimed at providing an intermediate transfer belt which is used to realize a highly durable, high-image-quality electrophotographic apparatus and which is flexible, superior in toner releasability, capable of realizing a high transfer rate without depending upon a transfer medium and capable of sustaining its properties over a long period of time; a method for producing the intermediate transfer belt; and an electrophotographic apparatus using the intermediate transfer belt.

As a result of carrying out earnest examinations, the present inventors have found that the above-mentioned problems can be solved by an intermediate transfer belt including the following members as its outermost surface: uniform convex regions formed by aligning independent spherical resin particles in a surface direction; and depressed regions formed of a lubricant layer which respectively lie between the convex regions.

Means for solving the problems are as follows.

<1> An intermediate transfer belt for use in an electrophotographic apparatus, including as an outermost surface thereof: uniform convex regions formed by aligning independent spherical resin particles in a surface direction; and depressed regions formed of a lubricant layer which respectively lie between the convex regions.

<2> The intermediate transfer belt according to <1>, further including a resin layer which contains one of a thermosetting elastomer and a rubber material, wherein the outermost surface lies over the resin layer, and the spherical resin particles are buried in the resin layer at a burial rate of greater than 50% but less than 100% with respect to a depth direction of the resin layer.

<3> The intermediate transfer belt according to <1> or <2>, wherein the spherical resin particles have a volume average particle diameter of 0.5 μm to 5.0 μm and are monodisperse particles.

<4> The intermediate transfer belt according to <2>, wherein at the uniform convex regions, the spherical resin particles do not lie on top of each other with respect to the depth direction of the resin layer.

<5> The intermediate transfer belt according to any one of <1> to <4>, wherein the lubricant layer contains a lubricant which is a long-chain fatty acid metal salt.

<6> The intermediate transfer belt according to <5>, wherein the long-chain fatty acid metal salt is zinc stearate.

<7> The intermediate transfer belt according to any one of <1> to <6>, wherein the spherical resin particles are silicone resin fine particles.

<8> An electrophotographic apparatus including: the intermediate transfer belt according to any one of <1> to <7>.

<9> The electrophotographic apparatus according to <8>, further including a mechanism which applies, over the intermediate transfer belt, the same lubricant as a lubricant contained in the lubricant layer.

<10> A method for producing an intermediate transfer belt, including: uniformly applying spherical resin particles over a resin layer of an intermediate transfer belt by dry coating; leveling the spherical resin particles so as to align the spherical resin particles and bury the spherical resin particles in the resin layer, thereby forming a uniform particle layer; applying a lubricant by dry coating: and uniformizing the lubricant, wherein the intermediate transfer belt includes as an outermost surface thereof: uniform convex regions formed by aligning independent spherical resin particles in a surface direction; and depressed regions formed of a lubricant layer which respectively lie between the convex regions.

<11> The method according to <10>, wherein the intermediate transfer belt further includes a resin layer which contains one of a thermosetting elastomer and a rubber material, and wherein the outermost surface lies over the resin layer, and the spherical resin particles are buried in the resin layer at a burial rate of greater than 50% but less than 100% with respect to a depth direction of the resin layer.

<12> The method according to <10> or <11>, wherein the spherical resin particles have a volume average particle diameter of 0.5 μm to 5.0 μm and are monodisperse particles.

<13> The method according to any one of <10> to <12>, wherein the lubricant layer contains a lubricant which is a long-chain fatty acid metal salt.

<14> The method according to <13>, wherein the long-chain fatty acid metal salt is zinc stearate.

The present invention makes it possible to provide an intermediate transfer belt which is capable of sustaining high transfer performance not just initially but over a long period of time without depending upon the type or surface properties of a transfer medium, and which is used to realize an electrophotographic apparatus that is highly durable and of high image quality over a long period of time; a method for producing the intermediate transfer belt; and an electrophotographic apparatus using the intermediate transfer belt.

DETAILED DESCRIPTION OF THE INVENTION

As described above, an intermediate transfer belt according to the present invention includes, as its outermost surface, uniform convex regions formed by aligning independent spherical resin particles in a surface direction, and regions formed of a lubricant layer.

The following explains the intermediate transfer belt of the present invention.

(Intermediate Transfer Belt)

An intermediate transfer belt of the present invention is used in an electrophotographic apparatus and includes the following members as an outermost surface thereof: uniform convex regions formed by aligning independent spherical resin particles in a surface direction; and depressed regions formed of a lubricant layer which respectively lie between the convex regions.

Here, the term "surface direction" means a direction horizontal to the surface of the intermediate transfer belt.

The intermediate transfer belt of the present invention is installed particularly suitably as an intermediate transfer belt in an electrophotographic apparatus of intermediate transfer belt type (an apparatus wherein a plurality of developed color-toner images sequentially formed over an image bearing member such as a photoconductor drum are primarily transferred by being superimposed onto one another over the intermediate transfer belt, then the primarily transferred images are secondarily transferred onto a recording medium at one time).

Figure 1:
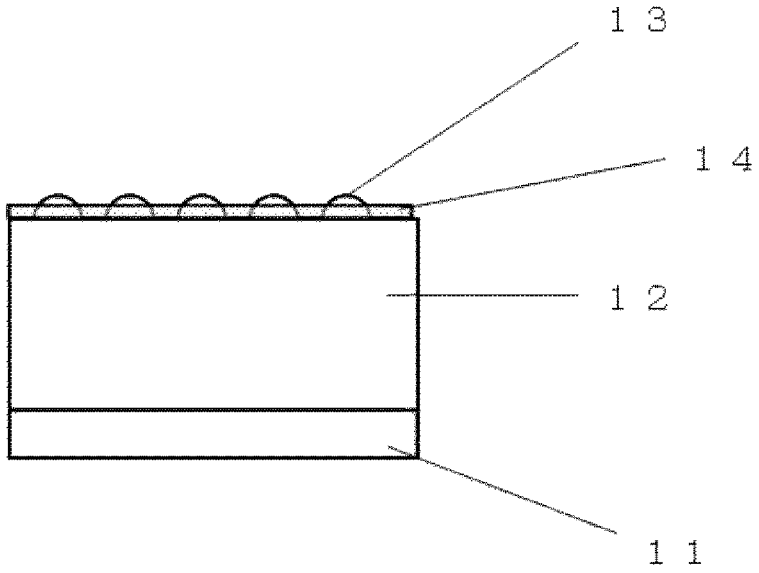
FIG. 1 is a schematic drawing showing an example of a layer structure of an intermediate transfer belt according to the present invention.

FIG. 1 shows a layer structure of an intermediate transfer belt suitably used in the present invention.

Note that the layer structure of the intermediate transfer belt of the present invention is not limited to this layer structure.

Regarding the foregoing structure, a flexible resin layer 12 is laid over a relatively-bendable rigid base layer 11; and convex regions formed of spherical resin particles 13, and depressed regions formed of a lubricant layer 14 are provided as an outermost surface over the resin layer 12.

<Base Layer>

First of all, the base layer 11 is explained.

As a constituent material for the base layer 11, a resin which contains a filler (or an additive) for adjusting electrical resistance, otherwise referred to as "electrical resistance adjuster", can be used, for example.

It is preferred in terms of flame retardance that the resin be a fluorine resin such as PVDF or ETFE, a polyimide resin, a polyamide-imide resin, etc.; it is particularly preferred in terms of mechanical strength (elasticity) and heat resistance that the resin be a polyimide resin or a polyamide-imide resin.

The electrical resistance adjuster is, for example, a metal oxide, carbon black, an ionic conductive agent or a conductive polymer material.

Examples of the metal oxide include zinc oxide, tin oxide, titanium oxide, zirconium oxide, aluminum oxide and silicon oxide. Also, the metal oxide may be surface-treated beforehand to enhance dispersibility.

Examples of the carbon black include ketjen black, furnace black, acetylene black, thermal black and gas black.

Examples of the ionic conductive agent include tetraalkylammonium salts, trialkylbenzylammonium salts, alkylsulfonate salts, alkylbenzenesulfonates, alkylsulfates, glycerin fatty acid esters, sorbitan fatty acid esters, polyoxyethylene alkylamines, polyoxyethylene fatty alcohol esters, alkylbetaines and lithium perchlorate. These may be used in combination.

Note that the electrical resistance adjuster in the present invention is not limited to the above-mentioned compounds mentioned as examples.

Also, a coating liquid containing at least a resin component, used in producing the intermediate transfer belt of the present invention, may if necessary contain additives such as a dispersion auxiliary agent, a reinforcing material, a lubricant, a heat-conducting material and an antioxidant.

The amount of the electrical resistance adjuster contained in a seamless belt suitably installed as the intermediate transfer belt is preferably adjusted such that the surface resistance value is kept in the range of $1\times10^{8}\Omega$/sq. to $1\times10^{13}\Omega$/sq. and the volume resistance value is kept in the range of $1\times10^{6}\Omega\cdot$cm to $1\times10^{12}\Omega\cdot$cm; in view of mechanical strength, the electrical resistance adjuster should be added in a selected amount that does not allow a formed film to become brittle and breakable.

That is, in producing the intermediate transfer belt, it is preferable to produce a seamless belt having a favorable balance between electrical properties (surface resistance and volume resistance) and mechanical strength, using a coating liquid prepared by mixing the resin (e.g., a polyimide resin precursor or a polyamide-imide resin precursor) and the electrical resistance adjuster in an appropriately adjusted manner.

In the present invention, in the case where the electrical resistance adjuster is carbon black, the amount of the electrical resistance adjuster occupies 10% by mass to 25% by mass, preferably 15% by mass to 20% by mass, of the total solid content of the coating liquid. Meanwhile, in the case where the electrical resistance adjuster is a metal oxide, the amount of the electrical resistance adjuster is in the range of 1% by mass to 50% by mass, preferably 10% by mass to 30% by mass, of the total solid content of the coating liquid. When the foregoing amounts are so small as to be outside the foregoing respective ranges, an adequate effect of adjusting the electrical resistance cannot be obtained. When the foregoing amounts are so large as to be outside the foregoing respective ranges, there is a decrease in the mechanical strength of the intermediate transfer belt (seamless belt), which is not favorable in practical use.

<Resin Layer>

Next, the resin layer (12) laid over the base layer (11) will be explained.

As the material for the resin layer (12), a general-purpose material such as a resin, elastomer or rubber can be used, and it is preferable to use a material which has sufficient flexibility (elasticity) to exhibit the effects of the present invention, so that preference is given to an elastomer material, rubber material, etc.

Examples of the elastomer material include thermoplastic elastomers and thermosetting elastomers. Examples of the thermoplastic elastomers include polyester elastomers, polyamide elastomers, polyether elastomers, polyurethane elastomers, polyolefin elastomers, polystyrene elastomers, polyacrylic elastomers, polydiene elastomers, silicone-modified polycarbonate elastomers and fluorine copolymer elastomers. Examples of the thermosetting elastomer include polyurethane elastomers, silicone-modified epoxy elastomers and silicone-modified acrylic elastomers.

Examples of the rubber material include isoprene rubber, styrene rubber, butadiene rubber, nitrile rubber, ethylene propylene rubber, butyl rubber, silicone rubber, chloroprene rubber, acrylic rubber, chlorosulfonated polyethylene, fluorine rubber, urethane rubber and hydrin rubber.

It is preferred that a material which can yield an intended performance be suitably selected from the elastomers and the rubbers.

It is particularly preferred that a soft material be selected to conform to the surface state of paper (which serves as a transfer material) whose surface is provided with protrusions and depressions, for example embossed leather-like paper.

In the present invention, among the above-mentioned materials, use of a thermosetting material is preferable to use of a thermoplastic material in view of formation of a spherical resin particle layer over the surface thereof. The thermosetting material is superior in terms of adhesion to the spherical resin particles due to the effects of a functional group contributing to a curing reaction to which the thermosetting material is subjected, and the thermosetting material enables the spherical resin particles to be surely fixed. Use of vulcanized rubber is preferable as well.

A resistance adjuster for adjusting electrical properties, a flame retardant for yielding flame retardance, and, if necessary, materials such as an antioxidant, a reinforcing agent, a filler and a vulcanization accelerator are suitably mixed with the material selected from the above-mentioned materials.

As the resistance adjuster for adjusting electrical properties, any of the above-mentioned materials usable for the electrical resistance adjuster can be used; it should, however, be noted that materials such as carbon black and metal oxides impair flexibility and are preferably used in reduced amounts, and use of an ionic conductive agent, a conductive polymer, etc. is effective as well. Also, the foregoing materials may be used in combination.

The resistance value of the resin layer is preferably adjusted such that the surface resistance value is kept in the range of $1\times10^{8}\Omega$/sq. to $1\times10^{13}\Omega$/sq. and the volume resistance value is kept in the range of $1\times10^{6}\Omega\cdot$cm to $1\times10^{12}\Omega\cdot$cm.

The thickness of the resin layer is preferably in the range of approximately 200 μm to approximately 2 mm. When the thickness is small, it is not favorable because there is a decrease in conformity to the surface properties of a transfer medium and there is a decrease in transfer pressure reducing effect. When the thickness is too great, it is not favorable because the resin layer is heavy, easily bends and easily causes instability in terms of traveling performance, and cracks are easily formed due to the curvature at a roller curvature section provided for setting the belt in a stretched manner.

<Spherical Resin Particles>

Next, the spherical resin particles formed at the surface of the resin layer are explained.

The spherical resin particles are not particularly limited and may be suitably selected according to the intended purpose, and examples thereof include spherical particles composed mainly of resins such as acrylic resins, melamine resins, polyamide resins, polyester resins, silicone resins and fluorine resins. Additionally, the surfaces of the particles containing any of these resin materials may be surface-treated with a different material.

Also, materials usable for the spherical resin particles herein stated include rubber material. The surfaces of spherical particles produced using the rubber material may be coated with a hard resin.

Also, the spherical resin particles may be hollow or may be porous.

Among the above-mentioned resins, silicone resins are most favorable in that they have lubricity and are highly capable of imparting abrasion resistance and releasability with respect to toner.

It is preferred that the spherical resin particles be particles in the shape of spheres produced by a polymerization method or the like, using any such resin; in the present invention, the closer the spherical resin particles are to true spheres, the better.

As for the particle diameter of the spherical resin particles, it is preferred that the volume average particle diameter thereof be in the range of 0.5 μm to 5.0 μm and that the spherical resin particles be monodispersed with a sharp distribution. When the volume average particle diameter is less than 0.5 μm, an effect of enhancing transfer performance cannot be adequately yielded by the particles. When the volume average particle diameter is greater than 5.0 μm, there is an increase in surface roughness and the space between particles enlarges, so that there may be troubles such as transfer failure of toner and cleaning failure.

Moreover, the particles are insulative in many cases, so that if the particle diameter is too large, charge potential remains because of the particles, thereby causing a trouble in which images are disturbed by accumulation of the potential at the time of continuous image printing.

Such monodisperse spherical resin particles can be uniformly aligned with ease by directly applying the spherical resin particles in powder form over the resin layer and leveling them.

By providing the outermost surface of the intermediate transfer belt with convex regions formed of the spherical resin particles, high toner-transferring performance can be realized even with a transfer material whose surface is rough to some extent; however, toner-transferring performance is not adequate with paper having large protrusions and large depressions. Specifically, when used, for example, with paper (such as embossed leather-like paper) of 175 kg or greater in ream weight, having a peak distance of 100 μm or greater between its protrusions and depressions, the resin layer expands due to deformation thereof as the resin layer conforms to the distance between the protrusions and the depressions, the distance between particles increases and the resin layer is exposed.

Increase in the distance between particles causes toner to touch the resin layer exposed between the particles, which leads to a decrease in transfer performance.

In the present invention, a lubricant layer is present at spaces between the spherical resin particles aligned over the resin layer.

<Lubricant Layer>

The lubricant layer may contain a lubricant in the form of oil, wax, powder, etc.; it is desirable to select the form of the lubricant in view of toner releasability, with preference being given to a long-chain fatty acid metal salt. The long-chain fatty acid metal salt is preferably zinc stearate. The lubricant is applied after the spherical resin particles have been fixed to the resin layer.

Simultaneous application of the spherical resin particles and the lubricant is not favorable because the alignment of the spherical resin particles becomes nonuniform and their fixation is hindered.

Regarding application of a long-chain fatty acid metal salt such as zinc stearate, it may be applied by wet coating; in the present invention, though, it is preferable to use a long-chain fatty acid metal salt in powder form, which has been made as fine as possible beforehand, and directly apply the long-chain fatty acid metal salt in powder form, or make the long-chain fatty acid metal salt into solid form, then apply it by rubbing. Application of the long-chain fatty acid metal salt in fine powder form is particularly preferable because gaps between particles of the spherical resin particles can be completely filled. After the application thereof in powder form, surplus powder is removed by leveling; on this occasion, the long-chain fatty acid metal salt can be formed into a thin film under a predetermined pressure, with heating if necessary, and firmly fixed.

Figure 2:
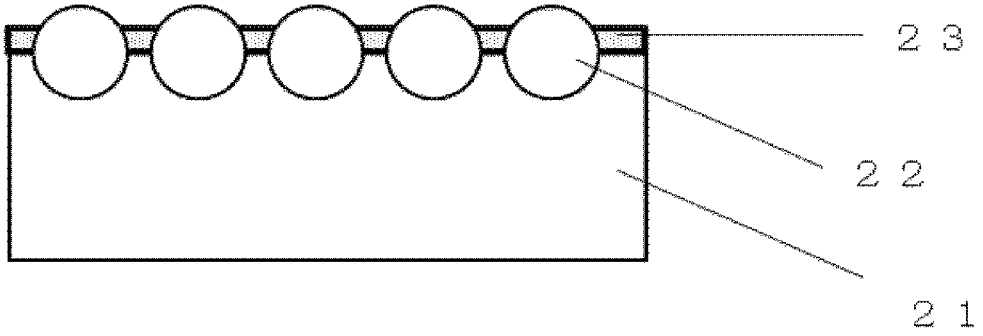
FIG. 2 is a schematic drawing showing a cross-sectional form of a surface layer of an intermediate transfer belt according to the present invention.

Next, a cross-sectional enlarged schematic drawing of a belt surface is shown in FIG. 2.

An embodiment of the intermediate transfer belt of the present invention is an intermediate transfer belt including the following members as its outermost surface formed over a resin layer 21: uniform convex regions formed by aligning independent spherical resin particles 22 in a surface direction; and depressed regions formed of a lubricant layer 23 which respectively lie between the convex regions, as shown in FIG. 2. The area ratio of the convex regions formed of the spherical resin particles 22 to the depressed regions formed of the lubricant layer 23 is preferably in the range of 60%:40% to 90%:10% in terms of the projected cross-sectional area of the particles. The projected cross-sectional area is worked out by photographing the belt surface with the use of an electronic microscope with a certain magnification, and calculating the area ratio of particle image portions to other portions with the use of image processing software, based upon the photographed image.

The magnification of the image at this time is suitably decided, for example according to the size of the particles; it is desirable that the magnification be such that the approximate number of particles included in a field of view is 100 to 300.

In the present invention, it is preferred that the spherical resin particles be buried in the resin layer, and that the burial rate be greater than 50% but less than 100% with respect to a depth direction of the resin layer. When the burial rate is 50% or less, detachment of the particles easily arises in the case of long-term use in an electrophotographic apparatus, and so the intermediate transfer belt may be inferior in durability. When the burial rate is 100%, it is not favorable because effects on transferrability, yielded by the particles, diminish.

The method for adjusting the rate at which the spherical resin particles are buried in the resin layer is not particularly limited and may be suitably selected according to the intended purpose. For example, the burial rate can be easily adjusted by controlling a pushing member's pushing force applied when the spherical resin particles are pushed against the resin layer. For example, by keeping the pushing force in the range of 1 mN/cm to 1,000 mN/cm, the relationship "50%<burial rate <100%" can be achieved relatively easily.

The burial rate is measured by observing a cross section of the belt with an electron-beam microscope.

It is preferred that, at the uniform convex regions, the spherical resin particles do not lie on top of each other with respect to the depth direction of the resin layer; in other words, it is preferred that, at the uniform convex regions, the spherical resin particles form a single layer with respect to the depth direction of the resin layer.

Figure 6:
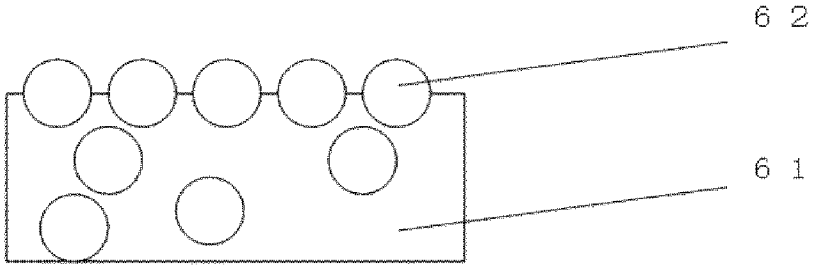
FIG. 6 is a schematic drawing showing a cross section of an intermediate transfer belt including a surface layer which contains particles in a plurality of layers.

If a plurality of particles are present with respect to the depth direction of the resin layer, as shown in FIG. 6 (where the numeral 61 denotes a resin layer, and the numeral 62 denotes particles), the distribution of the spherical resin particles contained is uneven and the belt surface has nonuniform electrical properties, affected by the electrical resistance value of the spherical resin particles, thereby disturbing images. Specifically, at portions where the spherical resin particles are present in large amounts, the electrical resistance value is high and surface potential is generated owing to residual charge; thus, there is a variation in surface potential at the belt surface, and disturbance of images is tangible, for example owing to a difference in image density between adjacent portions.

(Method for Producing Intermediate Transfer Belt)

A method of the present invention for producing an intermediate transfer belt includes the steps of: uniformly applying spherical resin particles over a resin layer of an intermediate transfer belt by dry coating; leveling the spherical resin particles so as to align the spherical resin particles and bury the spherical resin particles in the resin layer, thereby forming a uniform particle layer; applying a lubricant by dry coating; and uniformizing the lubricant, wherein the intermediate transfer belt includes the following members as an outermost surface thereof: uniform convex regions formed by aligning independent spherical resin particles in a surface direction; and depressed regions formed of a lubricant layer which respectively lie between the convex regions.

Next, an example of the method of the present invention for producing an intermediate transfer belt will be explained.

<Production of Base Layer>

First, a production method of a base layer is explained.

A method of producing a base layer with the use of a coating liquid containing at least a resin component, i.e., a coating liquid containing a polyimide resin precursor or a polyamide-imide resin precursor, is now explained.

While a cylindrical mold, e.g., a cylindrical metal mold, is being slowly rotated, a coating liquid containing at least a resin component (for example, a coating liquid containing a polyimide resin precursor or a polyamide-imide resin precursor) is applied and cast using a liquid-supplying device such as a dispenser or a nozzle so as to be uniformly present over the entire outer surface of the cylindrical mold (a coating film is formed). Thereafter, the rotational speed is increased to a predetermined speed, then when it has reached the predetermined speed, it is kept constant, and the rotation is continued for a desired length of time. Subsequently, with the cylindrical mold kept rotating, the solvent in the coating film is evaporated at approximately 80° C. to approximately 150° C. gradually increasing the temperature. In this process, it is preferable to remove vapor (the volatilized solvent, etc.) in the atmosphere by efficient circulation. When a film with a self-supporting property has been formed, this film and the mold are moved into a heating furnace (firing furnace) capable of high-temperature treatment, then the temperature is increased in steps and high-temperature heating (firing) is performed finally at approximately 250° C. to approximately 450° C. so as to sufficiently make the polyimide resin precursor or the polyamide-imide resin precursor into a polyimide resin or a polyamide-imide resin.

Cooling is sufficiently carried out, then the resin layer is laid over the base layer.

<Production of Resin Layer and Outermost Surface>

Here, a method of applying a thermosetting liquid elastomer material over the base layer so as to form a resin layer over the base layer is explained; note that the resin layer can be formed over the base layer by injection molding, extrusion molding, etc. as well. As in the production of the base layer, while a cylindrical metal mold is being slowly rotated, a coating liquid containing at least a thermosetting liquid elastomer material is applied and cast using a liquid-supplying device such as a dispenser or a nozzle so as to be uniformly present over the entire outer surface of the cylindrical mold (a coating film is formed).

Thereafter, the rotational speed is increased to a predetermined speed, then when it has reached the predetermined speed, it is kept constant, and the rotation is continued.

Figure 3:
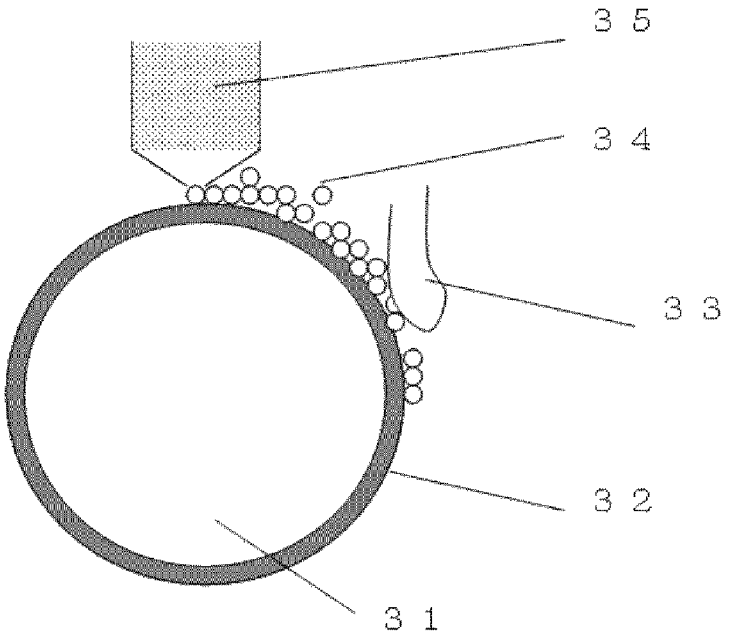
FIG. 3 is a schematic drawing showing a device to apply and fix powder particles for use in the present invention.

When the coating film has been sufficiently leveled, a powder applying device 35 and a pushing member 33 are placed as shown in FIG. 3; subsequently, while the cylindrical mold (mold drum 31) is being rotated, spherical resin particles 34 are supplied from the powder applying device 35 and uniformly applied over the surface of a belt 32, which includes the base layer and the resin layer, formed over the mold drum 31, then the pushing member 33 is pushed under a constant pressure against the spherical resin particles 34 applied over the surface. By means of the pushing member 33, the spherical resin particles 34 are buried in the resin layer, and while doing so, surplus particles among the spherical resin particles 34 are removed. In the present invention, it is particularly preferable to use monodisperse spherical resin particles, and use thereof makes it possible to form a uniform, single particle layer by a simple process that only involves the foregoing leveling performed by the pushing member 33.

After the formation of the uniform particle layer, the resin layer is cured by carrying out heating at a predetermined temperature for a predetermined length of time while rotating the cylindrical mold.

Next, a lubricant is applied. Previously fined lubricant powder is subjected to an application step and a leveling step using the devices shown in FIG. 3 as in the above explanation and then held. In the lubricant leveling step, the lubricant is firmly fixed by being leveled while being pressurized slightly more strongly than in the spherical resin particle leveling step.

Thereafter, the layers including the base layer are detached from the mold, and a desired seamless belt (intermediate transfer belt) is thus obtained.

(Electrophotographic Apparatus)

An electrophotographic apparatus of the present invention includes at least the above-mentioned intermediate transfer belt of the present invention and may, if necessary, include other members.

The seamless belt (intermediate transfer belt) produced by the above-mentioned method can, for example, be suitably used as an intermediate transfer belt for an electrophotographic apparatus of intermediate transfer type, wherein a plurality of developed color toner images sequentially formed over an image bearing member are primarily transferred by being sequentially superimposed onto one another over the intermediate transfer belt, and the primarily transferred images are secondarily transferred onto a recording medium at one time. With the seamless belt (intermediate transfer belt), it is possible to construct an electrophotographic apparatus capable of forming high-quality images.

Referring to main-part schematic drawings, the following specifically explains a seamless belt (intermediate transfer belt) for use in a belt formation unit installed in the electrophotographic apparatus according to the present invention. Note that each schematic drawing merely shows an example and the present invention is not confined thereto.

Figure 4:
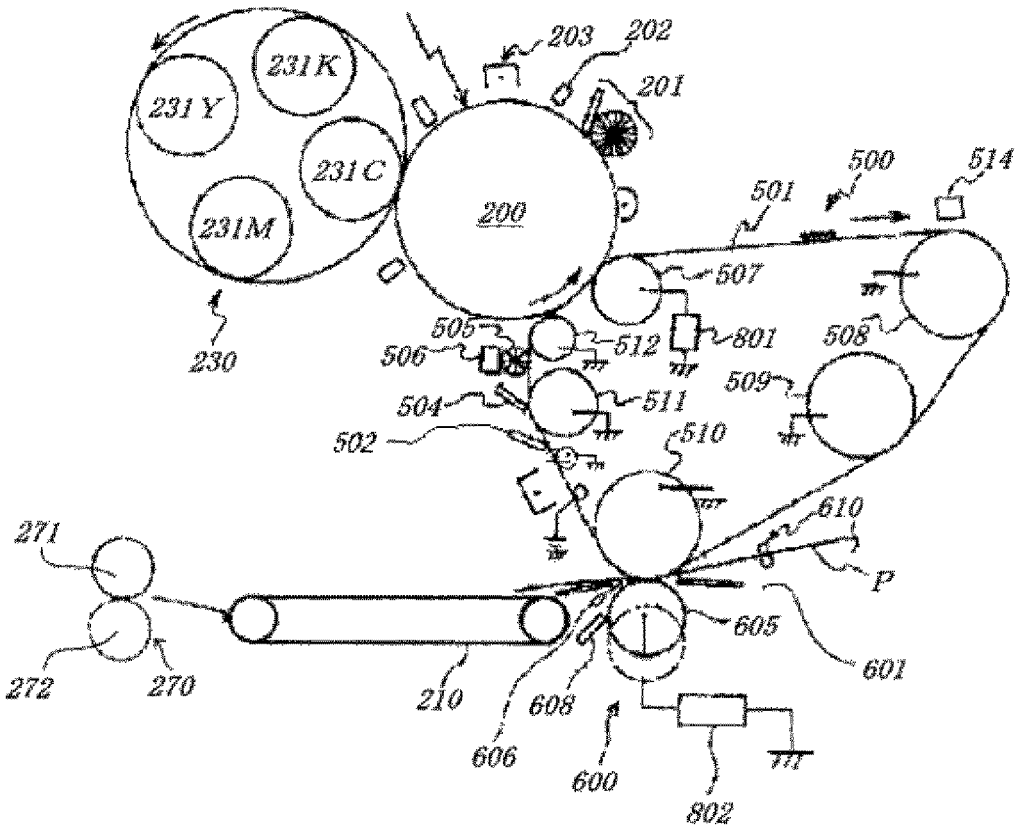
FIG. 4 is a main-part schematic drawing for explaining an electrophotographic apparatus which includes, as a belt member, an intermediate transfer belt obtained by a production method according to the present invention.

FIG. 4 is a main-part schematic drawing for explaining an electrophotographic apparatus wherein a seamless belt (intermediate transfer belt) obtained by the production method according to the present invention is installed as a belt member.

An intermediate transfer unit 500 including the belt member, shown in FIG. 4, incorporates members such as an intermediate transfer belt 501 serving as an intermediate transfer member that is set in a stretched manner on a plurality of rollers. Around this intermediate transfer belt 501, members including the following are disposed in such a manner as to face the belt: a secondary transfer bias roller 605 serving as a secondary transfer charge supplying unit of a secondary transfer unit 600, a belt cleaning blade 504 serving as an intermediate transfer member cleaning unit, and a lubricant applying brush 505 serving as a lubricant applying member of a lubricant applying unit.

Also, a mark (not shown in the drawing) for positional detection is provided on the outer circumferential surface or inner circumferential surface of the intermediate transfer belt 501. Note that in the case where the mark for positional detection is provided on the outer circumferential surface side of the intermediate transfer belt 501, it is necessary to make a skillful attempt and provide the mark so as not to be present in areas where the belt cleaning blade 504 passes, and this often involves difficulty in terms of placement; accordingly, in that case, the mark for positional detection may be provided on the inner circumferential surface side of the intermediate transfer belt 501. An optical sensor 514 serving as a mark detecting sensor is provided at a position between a belt driving roller 508 and a primary transfer bias roller 507 on which the intermediate transfer belt 501 is set.

The intermediate transfer belt 501 is set in a stretched manner on the primary transfer bias roller 507 serving as a primary transfer charge supplying unit, the belt driving roller 508, a belt tension roller 509, a secondary transfer opposed roller 510, a cleaning opposed roller 511 and a feedback current detecting roller 512. Each roller is formed of a conductive material, and the rollers except the primary transfer bias roller 507 are earthed. A transfer bias controlled to have a predetermined electric current or a predetermined voltage according to the number of toner images superimposed onto one another is applied to the primary transfer bias roller 507 by a primary transfer power source 801 controlled to have a constant electric current or a constant voltage.

The intermediate transfer belt 501 is driven in the direction of the arrow by the belt driving roller 508 which is rotationally driven in the direction of the arrow by a drive motor (not shown).

In general, the intermediate transfer belt 501 serving as a belt member is semiconductive or insulative and has a single-layer or multilayer structure; in the present invention, a seamless belt is preferably used as the intermediate transfer belt, and the use thereof improves durability and realizes superior image formation. Also, to allow toner images formed over a photoconductor drum 200 to be superimposed onto one another over the intermediate transfer belt, the intermediate transfer belt is made larger than the maximum size of paper allowed to be fed.

The secondary transfer bias roller 605 serving as a secondary transfer charge supplying unit is constructed in such a manner as to be able to touch and separate from the outer circumferential surface of the intermediate transfer belt 501 at the part where the intermediate transfer belt 501 is set in a stretched manner on the secondary transfer opposed roller 510. The secondary transfer bias roller 605 is placed such that transfer paper P serving as a recording medium can be sandwiched between the secondary transfer bias roller 605 and the intermediate transfer belt 501 at the part where the intermediate transfer belt 501 is set in a stretched manner on the secondary transfer opposed roller 510, and a transfer bias having a predetermined electric current is applied by a secondary transfer power source 802 controlled to have a constant electric current.

At a predetermined timing, a registration roller 610 sends transfer paper P as a transfer material to the part between the secondary transfer bias roller 605 and the intermediate transfer belt 501 set in a stretched manner on the secondary transfer opposed roller 510. A cleaning blade 608 serving as a cleaning unit is in contact with the secondary transfer bias roller 605. The cleaning blade 608 performs cleaning by removing matter attached to the surface of the secondary transfer bias roller 605.

In a color copier having such a structure, when an image formation cycle starts, the photoconductor drum 200 is rotated by a drive motor (not shown) in a counterclockwise direction as shown by the arrow, and a Bk (black) toner image, a C (cyan) toner image, an M (magenta) toner image and a Y (yellow) toner image are formed over the photoconductor drum 200. The intermediate transfer belt 501 is rotated by the belt driving roller 508 in a clockwise direction as shown by the arrow. As the intermediate transfer belt 501 rotates, the Bk toner image, the C toner image, the M toner image and the Y toner image are primarily transferred by the transfer bias created by the voltage applied to the primary transfer bias roller 507, and finally the toner images are formed over the intermediate transfer belt 501 in a superimposed manner in the order of Bk, C, M and Y.

For example, the Bk toner image is formed as follows.

In FIG. 4, by corona discharge, a charger 203 uniformly charges the surface of the photoconductor drum 200 with a negative charge and to a predetermined potential. With the timing being set based upon a signal for detection of the mark on the belt, raster exposure is performed with laser light by a writing optical unit (not shown) based upon a signal for a Bk image. When the image has been subjected to the raster exposure, charge in proportion to the exposure amount disappears at the exposed portion of the uniformly charged surface of the photoconductor drum 200 and a Bk latent electrostatic image is formed there. By contact between a negatively-charged Bk toner on a developing roller of a Bk developing device 231K and the Bk latent electrostatic image, the toner is not attached to portions of the photoconductor drum 200 where the charge remains, the toner adsorbs to portions where there is no charge, in other words exposed portions, and a Bk toner image which approximates to the latent electrostatic image is thus formed.

The Bk toner image thus formed over the photoconductor drum 200 is primarily transferred to the outer circumferential surface of the intermediate transfer belt 501 rotationally driven at a speed equal to and in contact with the photoconductor drum 200. Untransferred residual toner slightly remaining on the surface of the photoconductor drum 200 subsequent to the primary transfer is cleaned off by a photoconductor cleaning device 201 to prepare for reuse of the photoconductor drum 200. Regarding the photoconductor drum 200, a C image forming step takes place subsequent to the Bk image forming step, then a color scanner starts to read C image data at a predetermined timing, and a C latent electrostatic image is formed over the surface of the photoconductor drum 200 by writing with laser light based upon the C image data.

After passage of a rear end of the Bk latent electrostatic image and before arrival of a front end of the C latent electrostatic image, a revolver developing unit 230 is rotated, a C developing device 231C is set at a development position, and the C latent electrostatic image is developed with a C toner. The C latent electrostatic image area continues being developed; when a rear end of the C latent electrostatic image has passed, a revolver developing unit is rotated as in the case of the Bk developing device 231K mentioned earlier, and an M developing device 231M for a subsequent process is moved to the development position. This movement is completed before a front end of a Y latent electrostatic image for a subsequent process arrives at the development position (at which Y developing device 231Y is disposed or to which the Y developing device 231Y is moved). Explanations of an M image forming step and a Y image forming step are omitted on the grounds that they are similar to the above-mentioned Bk image forming step and the above-mentioned C image forming step in terms of reading of color image data, formation of a latent electrostatic image and developing operation.

The Bk, C, M and Y toner images sequentially formed over the photoconductor drum 200 as just described are sequentially positioned and primarily transferred onto the same surface of the intermediate transfer belt 501. Thus, toner images with a maximum of four colors combined together are formed over the intermediate transfer belt 501. Meanwhile, at the time when the image formation starts, transfer paper P is fed from a paper feed unit such as a transfer paper cassette or a manual feed tray and waits at a nip section of the registration roller 610.

Once a front end of the combined toner images on the intermediate transfer belt 501 nears a secondary transfer section where a nip section is formed by the secondary transfer bias roller 605 and the intermediate transfer belt 501 set in a stretched manner on the secondary transfer opposed roller 510, the registration roller 610 is driven such that a front end of the transfer paper P corresponds with the front end of the combined toner images, the transfer paper P is conveyed along a transfer paper guiding plate 601, and registration of the transfer paper P and the combined toner images is adjusted.

Thus, when the transfer paper P passes through the secondary transfer section, the four-color combined toner images on the intermediate transfer belt 501 are transferred (secondarily transferred) at one time onto the transfer paper P by a transfer bias created by a voltage applied to the secondary transfer bias roller 605 by the secondary transfer power source 802. The transfer paper P is conveyed along the transfer paper guiding plate 601, then subjected to charge elimination by passing through a section that faces a transfer paper charge-eliminating charger 606 that includes a charge eliminator placed downstream of the secondary transfer section, and subsequently sent toward a fixing device 270 by a belt conveying device 210 serving as a belt formation unit (see FIG. 4). The toner image is melted and fixed onto the transfer paper P at a nip section of fixing rollers 271 and 272 of the fixing device 270, then the transfer paper P is sent to the outside of the apparatus by a discharge roller (not shown) and laid over a copy tray (not shown) with the printed side facing upward. Note that the fixing device 270 may, if necessary, be provided with a belt formation unit.

Meanwhile, the surface of the photoconductor drum 200 having undergone the transfer of the images to the belt is cleaned by the photoconductor cleaning device 201 and uniformly subjected to charge elimination by a charge-eliminating lamp 202. Residual toner remaining on the outer circumferential surface of the intermediate transfer belt 501 subsequent to the secondary transfer of the toner images onto the transfer paper P is cleaned off by the belt cleaning blade 504. The belt cleaning blade 504 is made to touch and separate from the outer circumferential surface of the intermediate transfer belt 501 at a predetermined timing by a cleaning member attaching and detaching mechanism (not shown).

A toner sealing member 502 that touches and separates from the outer circumferential surface of the intermediate transfer belt 501 is provided upstream of the belt cleaning blade 504 with respect to the moving direction of the intermediate transfer belt 501. The toner sealing member 502 receives toner that has fallen from the belt cleaning blade 504 at the time of the cleaning off of the residual toner and prevents the toner that has fallen from scattering over the conveyance path of the transfer paper P. The toner sealing member 502 is made to touch and separate from the outer circumferential surface of the intermediate transfer belt 501 along with the belt cleaning blade 504 by the cleaning member attaching and detaching mechanism.

Over the outer circumferential surface of the intermediate transfer belt 501 from which the residual toner has been removed as just described, a lubricant 506 shaved off by the lubricant applying brush 505 is applied. The lubricant 506 is made of a solid material such as zinc stearate and placed so as to be in contact with the lubricant applying brush 505. Residual charge remaining on the outer circumferencial surface of the intermediate transfer belt 501 is removed with a charge-eliminating bias applied by a belt charge-eliminating brush (not shown) that is in contact with the outer circumferential surface of the intermediate transfer belt 501.

Here, the lubricant applying brush 505 and the belt charge-eliminating brush are made to touch and separate from the outer circumferential surface of the intermediate transfer belt 501 at a predetermined timing by respective attaching and detaching mechanisms (not shown).

Here, regarding operation of the color scanner and formation of images over the photoconductor drum 200 during repeated copy, a step of forming an image of the fourth color (Y) over a first sheet of transfer paper is followed at a predetermined timing by a step of forming an image of the first color (Bk) over a second sheet of transfer paper. Following the step of transferring four-color combined toner images to the first sheet of the transfer paper at one time, a Bk toner image for the second sheet is primarily transferred to the area on the outer circumferential surface of the intermediate transfer belt 501, cleaned by the belt cleaning blade 504. Thereafter, an operation similar to that for the first sheet is performed. The foregoing is to do with a copy mode for obtaining a full-color copy composed of the four colors; in the case where a three-color copy mode or a two-color copy mode is selected, a similar operation is performed for the designated colors and the designated number of times. In the case of a single-color copy mode, only the developing device of the predetermined color in the revolver developing unit 230 is left to conduct image development and copying operation is performed with the belt cleaning blade 504 left in contact with the intermediate transfer belt 501, until transfer of images to a predetermined number of sheets finishes.

Figure 5:
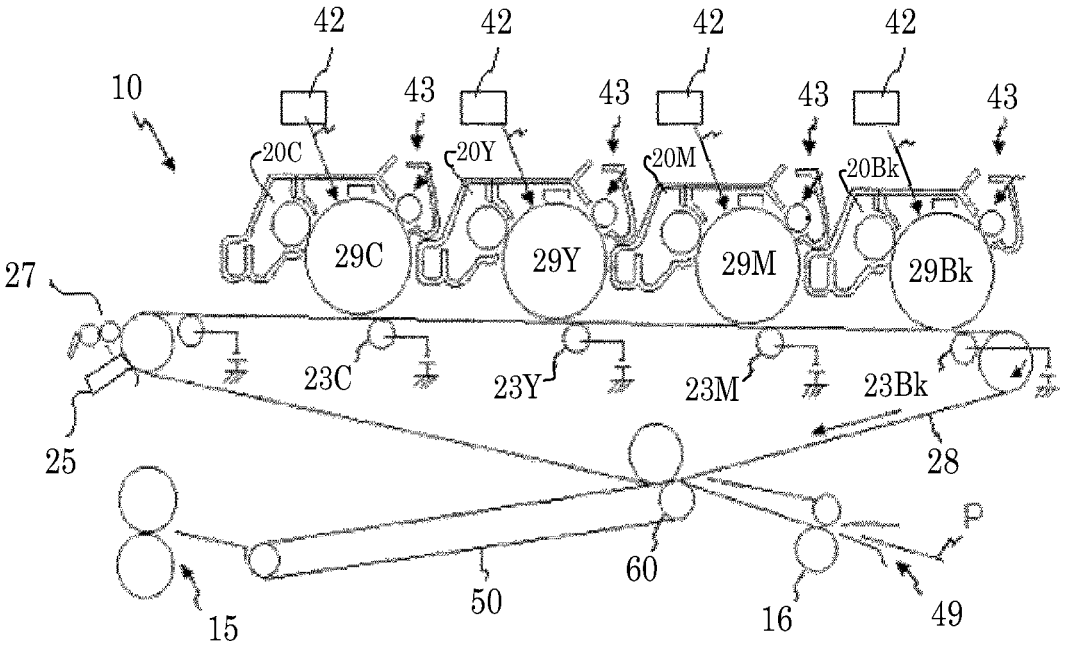
FIG. 5 is a main-part schematic drawing showing a structural example of an electrophotographic apparatus wherein a plurality of photoconductor drums are aligned along an intermediate transfer belt according to the present invention.

In the above embodiment, a copier provided with only one photoconductor drum has been explained; note that the present invention can also be applied, for example, to an electrophotographic apparatus wherein a plurality of photoconductor drums are aligned along one intermediate transfer belt that is a seamless belt, a structural example of which is shown in the main-part schematic drawing of FIG. 5.

FIG. 5 shows a structural example of a digital color printer of four-drum type, provided with four photoconductors (photoconductor drums) 29Bk, 29Y, 29M and 29C for forming toner images of four different colors (black, yellow, magenta and cyan).

In FIG. 5, a printer main body 10 includes image writing units 42, image forming units 43 and a paper feed unit 49 that are provided for performing electrophotographic color image formation. Based upon an image signal, image processing is carried out in an image processing unit to convert the image signal to signals of black (Bk), magenta (M), yellow (Y) and cyan (C) for image formation, and these signals are sent to the image writing units 42. The image writing units 42 are, for example, laser scanning optical systems each composed of a laser light source, a deflector such as a rotary polygon mirror, a scanning image-forming optical system and a group of mirrors, and respectively include four writing optical paths that correspond to the signals of each color, thereby writing images onto the image bearing members (photoconductors) 29Bk, 29M, 29Y and 29C for each color in the image forming units 43 based upon the signals of each color.

The image forming units 43 respectively include the photoconductors 29Bk, 29M, 29Y and 29C serving as image bearing members for black (Bk), magenta (M), yellow (Y) and cyan (C).

As the photoconductors for each color, organic photoconductors are generally used. Around the photoconductors 29Bk, 29M, 29Y and 29C, the following members are provided: charging devices; exposing units using laser light from the image writing units 42; developing devices 20Bk, 20M, 20Y and 20C for black, magenta, yellow and cyan respectively; primary transfer bias rollers 23Bk, 23M, 23Y and 23C as primary transfer units; cleaning devices (not shown); photoconductor charge-eliminating devices (not shown); and so forth. The developing devices 20Bk, 20M, 20Y and 20C employ a developing method with two-component magnetic brushes. An intermediate transfer belt 28 serving as a belt formation member lies between the photoconductors 29Bk, 29M, 29Y and 29C and the primary transfer bias rollers 23Bk, 23M, 23Y and 23C, and toner images of each color formed over the respective photoconductors are sequentially superimposed onto one another over the intermediate transfer belt 28 and thus transferred.

Transfer paper P is fed from the paper feed unit 49 and then borne on a transfer conveyance belt 50 serving as a belt formation member, with the aid of a registration roller 16. The toner images transferred onto the intermediate transfer belt 28 are secondarily transferred (transferred at one time) by a secondary transfer bias roller 60 as a secondary transfer unit, at the part where the intermediate transfer belt 28 and the transfer conveyance belt 50 come into contact with each other. Thus, a color image is formed over the transfer paper P. The transfer paper P with the color image formed thereon is conveyed to a fixing device 15 by the transfer conveyance belt 50 so as to fix the transferred image by this fixing device 15, then the transfer paper P with the fixed image is discharged to the outside of the printer main body.

Residual toner remaining on the intermediate transfer belt 28, which was not transferred at the time of the secondary transfer, is removed from the intermediate transfer belt 28 by a belt cleaning member 25.

A lubricant applying device 27 is placed downstream of the belt cleaning member 25. This lubricant applying device 27 includes a solid lubricant, and a conductive brush to apply the solid lubricant by rubbing against the intermediate transfer belt 28. Being always in contact with the intermediate transfer belt 28, the conductive brush applies the solid lubricant over the intermediate transfer belt 28. The solid lubricant has the function of enhancing the cleanability of the intermediate transfer belt 28, preventing the occurrence of filming, and improving the durability of the intermediate transfer belt 28.

Regarding the lubricant applying unit and the lubricant applying device in the apparatuses shown in FIGS. 4 and 5, by using the same lubricant as the lubricant provided on the surface of the intermediate transfer belt and supplying a lubricant component that can be removed by abrasion, etc. during long-term use, the intermediate transfer belt can be used enduringly.

EXAMPLES

Example 1

<Production of Intermediate Transfer Belt>

<<Production of Base Layer>>

A coating liquid for a base layer was prepared as described below, and a seamless belt base layer was produced using this coating liquid.

—Preparation of Coating Liquid for Base Layer—

Firstly, a dispersion liquid prepared beforehand by dispersing carbon black (SPECIAL BLACK 4, manufactured by Evonik Degussa) in N-methyl-2-pyrrolidone using a bead mill was mixed with a polyimide varnish (U-VARNISH A, manufactured by Ube Industries, Ltd.) composed mainly of a polyimide resin precursor, such that the carbon black content became 17% by mass of the polyamic acid solid content, then sufficient stirring was performed, and a coating liquid was thus prepared.

Secondly, using as a mold a metal cylinder whose outer surface (outer diameter: 320 mm, length: 360 mm) had been roughened by blasting, the coating liquid for a base layer was applied with a dispenser so as to be uniformly cast over the cylinder outer surface while the cylindrical mold was being rotated at a rotational speed of 50 rpm (revolutions/minute). At the time when the whole of a predetermined amount of the coating liquid had been made to flow and thus a coating film had spread evenly, the rotational speed was increased to 100 rpm and heating was carried out for 60 minutes using a hot-air circulation dryer, with the temperature gradually increased to 110° C. With a further increase in temperature to 200° C., heating was carried out for 20 minutes, the rotation was stopped, slow cooling was carried out, the cylindrical mold with a molded film formed thereover was taken out and then set in a heating furnace (firing furnace) capable of high-temperature treatment, and heat treatment (firing) was carried out for 60 minutes with the temperature increased to 320° C. in steps.

With sufficient cooling, a base layer was produced.

<<Production of Resin Layer and Outermost Surface>>

Using a coating liquid for a resin layer, which had the following composition, a resin layer was formed over the base layer.

Firstly, the constituent materials below were mixed together and then sufficiently kneaded using a biaxial kneader to produce a masterbatch.

—Constituent Materials of Carbon Masterbatch A for Intermediate Layer—

| | |
|---|---|
| Epoxy-silicone copolymer ALBIFLEX 348 (silicone 60 wt %, manufactured by nanoresins AG) | 20 parts by mass |
| VULCAN XC72 as carbon black (manufactured by Cabot Corporation) | 100 parts by mass |

Using the carbon masterbatch A, the constituent materials below were mixed together to obtain a coating liquid.

—Constituent Materials of Coating Liquid for Resin Layer—

| | |
|---|---|
| The above-mentioned carbon masterbatch A | 8 parts by mass |
| Epoxysilicone copolymer ALBIFLEX 348 (silicone 60 wt %, manufactured by nanoresins AG) | 40 parts by mass |
| Methyltetrahydrophthalic anhydride HN-2000 (manufactured by Hitachi Chemical Company, Ltd.) | 8 parts by mass |

Using a dispenser, the coating liquid for a resin layer was cast and applied uniformly over the outer surface of the previously produced polyimide base layer. The amount of the coating liquid applied was adjusted such that the coating liquid had a final film thickness of 300 μm. At the time when the whole of a predetermined amount of the coating liquid had been made to flow and thus a coating film had spread evenly, acrylic resin spherical particles (TECHPOLYMER MBX-SS Series (volume average particle diameter: 1 μm, monodisperse particles), manufactured by SEKISUI PLASTICS CO., Ltd.) as spherical resin particles were evenly sprinkled over the surface using the method related to FIG. 3, and a pushing member of a polyurethane rubber blade was pushed against the spherical resin particles at a pushing force of 100 mN/cm to fix the spherical resin particles to the resin layer.

After the entire belt surface had finished undergoing the above-mentioned treatment, the belt was placed in a hot-air circulation dryer while being rotated, then the belt was heated for 30 minutes with the temperature being increased to 120° C. at a temperature increase rate of 4° C./min. Then, continuously, the belt was heated for 120 minutes with the temperature increased to 250° C. at a temperature increase rate of 4° C./min. The heating was halted and then slow cooling was carried out to normal temperature.

Subsequently, using the method related to FIG. 3 again, powder of zinc stearate (ZINC STEARATE GF-200, manufactured by NOF CORPORATION) was evenly sprinkled over the surface, and a pushing member of a polyurethane rubber blade was pushed against the powder to fix the powder.

Thus, what was formed was an outermost surface including: uniform convex regions formed by aligning independent spherical resin particles in a surface direction; and depressed regions formed of a lubricant layer which respectively lay between the convex regions. At the uniform convex regions, the spherical resin particles did not lie on top of each other with respect to a depth direction of the resin layer.

The above-mentioned members formed over the mold were detached from the mold, and an intermediate transfer belt A was thus obtained.

Example 2

An intermediate transfer belt, named "intermediate transfer belt B", was obtained in the same manner as in Example 1 except that the spherical resin particles were changed to silicone resin particles (X-52-854 (volume average particle diameter: 0.8 μm, monodisperse particles), manufactured by Shin-Etsu Chemical Co., Ltd.).

Example 3

An intermediate transfer belt, named "intermediate transfer belt C", was obtained in the same manner as in Example 1 except that the spherical resin particles were changed to silicone resin particles (TOSPEARL 120 (volume average particle diameter: 2.0 μm, monodisperse particles), manufactured by Momentive Performance Materials Inc.).

Example 4

An intermediate transfer belt, named "intermediate transfer belt D", was obtained in the same manner as in Example 1 except that the spherical resin particles were changed to silicone resin particles (KMP701 (volume average particle diameter: 3.5 μm, monodisperse particles), manufactured by Shin-Etsu Chemical Co., Ltd.).

Example 5

An intermediate transfer belt, named "intermediate transfer belt E", was obtained in the same manner as in Example 1 except that the spherical resin particles were changed to silicone resin particles (TOSPEARL 2000B (volume average particle diameter: 6.0 μm, monodisperse particles), manufactured by Momentive Performance Materials Inc.).

Example 6

An intermediate transfer belt, named "intermediate transfer belt F", was obtained in the same manner as in Example 1 except that the spherical resin particles were changed to acrylic resin spherical particles (TECHPOLYMER XX-16FM (volume average particle diameter: 0.3 μm, monodisperse particles), manufactured by SEKISUI PLASTICS CO., Ltd.).

Example 7

An intermediate transfer belt, named "intermediate transfer belt G", was obtained in the same manner as in Example 1 except that the zinc stearate (ZINC STEARATE GF-200, manufactured by NOF CORPORATION) was changed to calcium stearate (CALCIUM STEARATE GF-200, manufactured by NOF CORPORATION).

Example 8

An intermediate transfer belt, named "intermediate transfer belt H", was obtained in the same manner as in Example 1 except that the zinc stearate (ZINC STEARATE GF-200, manufactured by NOF CORPORATION) was changed to zinc laurate (ZINC LAURATE GP, manufactured by NOF CORPORATION).

Comparative Example 1

An intermediate transfer belt, named "intermediate transfer belt I", was produced in the same manner as in Example 1 except that the spherical resin particles were not used and the lubricant layer was not formed.

Comparative Example 2

An intermediate transfer belt, named "intermediate transfer belt J", was produced in the same manner as in Example 1 except that the lubricant layer was not formed.

Comparative Example 3

An intermediate transfer belt, named "intermediate transfer belt K", was produced in the same manner as in Example 1 except that the spherical resin particles were not formed.

The following evaluations were carried out, installing each of the intermediate transfer belts A to K of Examples and Comparative Examples in the electrophotographic apparatus shown in FIG. 5.

For the lubricant applying device 27, zinc stearate powder was used.

The projected cross-sectional area ratios and the burial rates of the spherical resin particles at the surfaces of the respective belts according to Examples and Comparative Examples were as shown in Table 1.

TABLE 1

| | Projected cross-sectional area ratio of particles (%) | Burial rate of particles (%) |
|---|---|---|
| Ex. 1 | 70 | 65 |
| Ex. 2 | 75 | 53 |
| Ex. 3 | 75 | 75 |
| Ex. 4 | 80 | 85 |
| Ex. 5 | 75 | 78 |
| Ex. 6 | 60 | 51 |
| Ex. 7 | 70 | 65 |
| Ex. 8 | 70 | 65 |
| Comp. Ex. 1 | — | — |
| Comp. Ex. 2 | 70 | 65 |
| Comp. Ex. 3 | — | — |

(1) Measurement of Transfer Rate

A blue solid image was printed onto paper (embossed leather-like paper; ream weight: 175 kg) whose surface was provided with a pattern of protrusions and depressions, used as transfer paper, then the amount of toner on the intermediate transfer belt before transfer of the image to the paper and the amount of toner remaining on the intermediate transfer belt after the transfer of the image to the paper were measured, and the transfer rate was calculated in accordance with Equation 1 below.

$$\text{Transfer rate (\%)} = \left(1 - \frac{\text{Amount of toner on belt after transfer } (g)}{\text{Amount of toner on belt before transfer } (g)}\right) \times 100 \quad \text{Equation 1}$$

(2) Measurement of Transfer Rate when Image Had been Continuously Printed onto 10,000 Sheets of Paper After a test chart had been continuously printed onto 10,000 sheets of paper, the printing was halted, and the transfer rate was measured as explained in (1) above.

(3) Evaluation of Image when Image Had been Continuously Printed Onto 10,000 Sheets of Paper After a test chart had been continuously printed onto 10,000 sheets of paper, a single-color halftone image of cyan was printed onto the entire surface of paper (embossed leather-like paper) of 175 kg in ream weight, and an observation was carried out regarding the presence, absence or extent of an abnormal image.

Example 9

Evaluations were carried out in the same manner as the evaluations of Example 3 except that the lubricant (zinc stearate) applying device 27 was detached from the electrophotographic apparatus.

The results were as shown Table 2.

TABLE 2

| | | Initial | After printing of image onto 10,000 sheets of paper | | |
|---|---|---|---|---|---|
| | Belt | Transfer rate (%) | Transfer rate (%) | Abnormal image | Other abnormality |
| Ex. 1 | A | 95.3 | 94.1 | None | None |
| Ex. 2 | B | 95.6 | 94.6 | None | None |
| Ex. 3 | C | 97.5 | 97.2 | None | None |
| Ex. 4 | D | 96.1 | 95.8 | None | None |
| Ex. 5 | E | 93.8 | 93.2 | There was an abnormal image partially existing in the form of streaks. | Cleaning failure resulting in the form of streaks was partially observed. |
| Ex. 6 | F | 92.1 | 92.3 | None | None |
| Ex. 7 | G | 96.5 | 95.1 | None | None |
| Ex. 8 | H | 95.6 | 93.3 | None | None |
| Comp. Ex. 1 | I | 45.2 | 43.3 | The color density was low and there were white spots (non-printed parts) at depressions. | There was fixation of toner on the belt. |
| Comp. Ex. 2 | J | 85.2 | 80.2 | There were white spots (non-printed parts) at depressions. | None |

TABLE 2-continued

| | Belt | Initial Transfer rate (%) | After printing of image onto 10,000 sheets of paper Transfer rate (%) | Abnormal image | Other abnormality |
|---|---|---|---|---|---|
| Comp. Ex. 3 | K | 72.3 | 63.3 | The color density was low and there were white spots (non-printed parts) at depressions. | None |
| Ex. 9 | C | 97.5 | 94.1 | There were white spots (non-printed parts) partially observed at depressions. | None |

As described above, the present invention makes it possible to obtain an intermediate transfer belt which is used to realize a highly durable, high-image-quality electrophotographic apparatus and which is capable of realizing a high transfer rate without depending upon a transfer medium and capable of sustaining its properties over a long period of time.

What is claimed is:

1. An intermediate transfer belt for use in an electrophotographic apparatus, comprising as an outermost surface thereof:

uniform convex regions formed by aligning independent spherical resin particles in a surface direction; and depressed regions formed of a lubricant layer which respectively lie between the convex regions, wherein the intermediate transfer belt further comprises a resin layer which contains one of a thermosetting elastomer and a rubber material, wherein the outermost surface of the intermediate transfer belt lies over the resin layer, and the spherical resin particles are buried in the resin layer at a burial rate of greater than 50% but less than 100% with respect to a depth direction of the resin layer, wherein the spherical resin particles forming the uniform convex regions of the outermost surface of the intermediate transfer belt are silicone resin fine particles, wherein the thermosetting elastomer is selected from the group consisting of polyurethane elastomer, silicone-modified epoxy elastomer and silicone-modified acrylic elastomer, and wherein the rubber material is selected from the group consisting of isoprene rubber, styrene rubber, butadiene rubber, nitrile rubber, ethylene propylene rubber, butyl rubber, silicone rubber, chloroprene rubber, acrylic rubber, chlorosulfonated polyethylene, fluorine rubber, urethane rubber and hydrin rubber.

2. The intermediate transfer belt according to claim 1, wherein the spherical resin particles have a volume average particle diameter of 0.5 μm to 5.0 μm and are monodisperse particles.

3. The intermediate transfer belt according to claim 1, wherein at the uniform convex regions, the spherical resin particles do not lie on top of each other with respect to the depth direction of the resin layer.

4. The intermediate transfer belt according to claim 1, wherein the lubricant layer contains a lubricant which is a long-chain fatty acid metal salt.

5. The intermediate transfer belt according to claim 4, wherein the long-chain fatty acid metal salt is zinc stearate.

6. The intermediate transfer belt according to claim 1, wherein an area ratio of the uniform convex regions to the depressed regions is in a range of 60%:40% to 90%:10% in terms of a projected cross-sectional area of the spherical resin particles.

7. An electrophotographic apparatus comprising:

an intermediate transfer belt which comprises as an outermost surface thereof: uniform convex regions formed by aligning independent spherical resin particles in a surface direction; and depressed regions formed of a lubricant layer which respectively lie between the convex regions, wherein the intermediate transfer belt further comprises a resin layer which contains one of a thermosetting elastomer and a rubber material, wherein the outermost surface of the intermediate transfer belt lies over the resin layer, and the spherical resin particles are buried in the resin layer at a burial rate of greater than 50% but less than 100% with respect to a depth direction of the resin layer, wherein the spherical resin particles forming uniform convex regions of the outermost surface of the intermediate transfer belt are silicone resin fine particles, wherein the thermosetting elastomer is selected from the group consisting of polyurethane elastomer, silicone-modified epoxy elastomer and silicone-modified acrylic elastomer, and wherein the rubber material is selected from the group consisting of isoprene rubber, styrene rubber, butadiene rubber, nitrile rubber, ethylene propylene rubber, butyl rubber, silicone rubber, chloroprene rubber, acrylic rubber, chlorosulfonated polyethylene, fluorine rubber, urethane rubber and hydrin rubber.

8. The electrophotographic apparatus according to claim 7, further comprising a mechanism which applies, over the intermediate transfer belt, the same lubricant as a lubricant contained in the lubricant layer.

9. The electrophotographic apparatus according to claim 7, wherein the spherical resin particles have a volume average particle diameter of 0.5 μm to 5.0 μm and are monodisperse particles.

10. The electrophotographic apparatus according to claim 7, wherein the lubricant layer contains a lubricant which is a long-chain fatty acid metal salt.

11. The electrophotographic apparatus according to claim 10, wherein the long-chain fatty acid metal salt is zinc stearate.

* * * * *